US006737818B2

(12) United States Patent
Sakurai et al.

(10) Patent No.: US 6,737,818 B2
(45) Date of Patent: May 18, 2004

(54) DEFLECTION YOKE AND CATHODE RAY TUBE DEVICE

(75) Inventors: Soichi Sakurai, Yokohama (JP); Hiroshi Jitsukata, Yokohama (JP); Nobutaka Okuyama, Yokohama (JP); Katsumi Hirota, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/295,768

(22) Filed: Nov. 14, 2002

(65) Prior Publication Data

US 2003/0094910 A1 May 22, 2003

(30) Foreign Application Priority Data

Nov. 22, 2001 (JP) ..... 2001-356855

(51) Int. Cl.[7] ..... H01J 29/70

(52) U.S. Cl. ..... 315/382; 315/382.1; 313/413; 313/440

(58) Field of Search ..... 315/382, 382.1, 315/368.11; 313/440, 413

(56) References Cited

U.S. PATENT DOCUMENTS

| | | | |
|---|---|---|---|
| 5,070,280 | A | 12/1991 | Okuyama et al. |
| 5,118,999 | A | 6/1992 | Jackson et al. |
| 5,119,056 | A | 6/1992 | Ito et al. |
| 5,138,290 | A | 8/1992 | Togane et al. |
| 5,166,576 | A | 11/1992 | Roussel et al. |
| 5,192,898 | A | 3/1993 | Dossot et al. |
| 5,485,054 | A | 1/1996 | Van Kemenade et al. |
| 5,489,826 | A | 2/1996 | Knight et al. |
| 5,598,055 | A | 1/1997 | Inoue et al. |
| 6,476,569 | B2 | 11/2002 | Aoki et al. |

FOREIGN PATENT DOCUMENTS

| | | |
|---|---|---|
| JP | 02-129846 | 5/1990 |
| JP | 05-49036 | 2/1993 |
| JP | 07-21942 | 1/1995 |
| JP | 07-201285 | 8/1995 |
| JP | 07-220657 | 8/1995 |
| JP | 08-162045 | 6/1996 |
| JP | 08-222150 | 8/1996 |
| JP | 09-27283 | 1/1997 |
| JP | 10-199449 | 7/1998 |
| JP | 11-176352 | 7/1999 |
| JP | 11-354062 | 12/1999 |
| JP | 2000-21330 | 1/2000 |
| JP | 2001-23539 | 1/2001 |
| JP | 2001-176426 | 6/2001 |
| JP | 2001-216918 | 6/2001 |

*Primary Examiner*—David Vu
(74) *Attorney, Agent, or Firm*—Townsend and Townsend and Crew LLP

(57) ABSTRACT

An electron beam trajectory controlling device includes a main deflection section having a first main coil and defining a first path and being configured to control a trajectory of an electron traveling along the first path. The main deflection section includes a first auxiliary coil provided proximate the first main coil. A minor deflection section is provided adjacent to the main deflection section and has a first minor coil that is coupled to the first auxiliary coil. The minor deflection section defines a second electron path that is aligned to the first path. The minor deflection section cooperates with the main deflection section to control the trajectory of the electron.

40 Claims, 4 Drawing Sheets

DEFLECTION YOKE AND CATHODE RAY TUBE DEVICE

CROSS-REFERENCES TO RELATED APPLICATIONS

The present application is related to and claims priority from Japanese Patent Application No. 2001-356855, filed on Nov. 22, 2001, and Japanese Patent Application No. 2002-280152, filed on Sep. 26, 2002.

BACKGROUND OF THE INVENTION

The present invention relates to a display device, and particularly to a cathode ray tube including a deflection yoke and a display device thereof.

In one conventional technique, a horizontal auxiliary coil and a vertical auxiliary coil are wound toroidally about a main core, and a horizontal auxiliary transformer or a vertical auxiliary transformer is provided to cancel a voltage induced from a main deflection yoke (see, FIGS. 3 to 5 of Japanese Patent Laid-Open No. 2-129846). The main core defines the sole deflection yoke in this art.

In another conventional technique, a portion of a coil of a main deflection yoke is wound about a minor core (see, FIG. 1 of Japanese Patent Laid-Open No. 2000-21330). Accordingly, the portion of the coil wound about the minor yoke cooperates with a portion of the coil wound about the main core to more finely control the trajectory of electrons passing through the main and minor cores, i.e., increase the deflection sensitivity.

BRIEF SUMMARY OF THE INVENTION

In first conventional technique, the deflection sensitivity is reduced since it is necessary to provide a horizontal auxiliary transformer or a vertical auxiliary transformer, which also increases the manufacturing cost. Manufacturing such a deflection yoke also is more complicated, thereby raising reliability concerns.

The second conventional technique, on the other hand, provides an improvement in sensitivity of a main deflection yoke since a portion of a coil of a main deflection yoke is wound about a minor core. However, no mechanism is provided for improving the sensitivity of the minor deflection yoke. Additionally, a crosstalk voltage results from a magnetic field leakage of the main deflection yoke to the minor deflection yoke, thus interfering with the operation of the minor deflection yoke with respect to a drive circuit.

A deflection yoke according to one embodiment of the present invention improves deflection sensitivity of a minor deflection yoke and reduces or suppresses a crosstalk voltage. The deflection yoke can be manufactured with a simplified configuration at a lower cost.

In one embodiment, an electron beam trajectory controlling device includes a main deflection section having a first main coil and defining a first path and being configured to control a trajectory of an electron traveling along the first path. The main deflection section includes a first auxiliary coil provided proximate the first main coil. A minor deflection section is provided adjacent to the main deflection section and has a first minor coil that is coupled to the first auxiliary coil. The minor deflection section defines a second electron path that is aligned to the first path. The minor deflection section cooperates with the main deflection section to control the trajectory of the electron.

In one embodiment, a device for deflecting an electron beam includes a main deflection section defining a first path and being configured to deflect the electron beam traveling along the first path. The main deflection section provides a coarse deflection control of the electron beam. The main deflection section includes a first main conductive component configured to generate a magnetic field to deflect the electron beam traveling along the first path in a first direction, a second main conductive component configured to generate a magnetic field to deflect the electron beam traveling along the first path in a second direction, a first auxiliary conductive component, and a second auxiliary conductive component. A minor deflection section is provided adjacent to the main deflection section. The minor deflection section defines a second path that is aligned to the first path and provides a fine deflection control of the electron beam. The minor deflection includes a first minor conductive component that is coupled to the first auxiliary conductive component and configured to deflect the electron beam along the first direction, and a second minor conductive component that is coupled to the second auxiliary conductive component and configured to deflect the electron beam along the second direction. The first auxiliary conductive component cooperates with the first minor conductive component to reduce a crosstalk voltage generated in the minor deflection section. The first minor conductive component is not coupled to the first major conductive component.

In another embodiment, a cathode ray tube includes a display surface and a deflection assembly. The deflection assembly includes a main deflection section having a first main coil and defining a first electron beam path and being configured to control a trajectory of an electron beam traveling along the first path. The main deflection section includes a first auxiliary coil provided proximate the first main coil. The assembly also includes a minor deflection section provided adjacent to the main deflection section. The minor deflection section has a first minor coil that is coupled to the first auxiliary coil and defines a second electron beam path that is aligned to the first electron beam path. The minor deflection section cooperates with the main deflection section to control the trajectory of the electron beam.

In yet another embodiment, a display device includes a housing having an opening and a cathode ray tube provided within the housing and having a display surface, the display surface aligned to the opening of the housing. The cathode ray tube includes a main deflection section having a first main coil and defining a first electron path and being configured to control a trajectory of an electron traveling along the first electron path, the main deflection section including a first auxiliary coil provided proximate the first main coil. The tube also includes a minor deflection section provided adjacent to the main deflection section and having a first minor coil that is coupled to the first auxiliary coil, the minor deflection section defining a second electron path that is aligned to the first electron path, the minor deflection section cooperating with the main deflection section to control the trajectory of the election. The inductances of the first auxiliary and minor coils are met to satisfy the following condition, $0.005 \leqq L_{a1}/L_{m1} \leqq 0.7$, where La1 denotes the inductance of the first auxiliary coil and Lm1 denotes the inductance of the first minor coil.

DETAILED DESCRIPTION OF THE INVENTION

While the present invention has been described herein using several embodiments thereof, it should be understood that the disclosed embodiments might be altered or modified without departing from the scope of the invention. Therefore, the scope of the present invention should be interpreted using the appended claims.

Figure 1A:
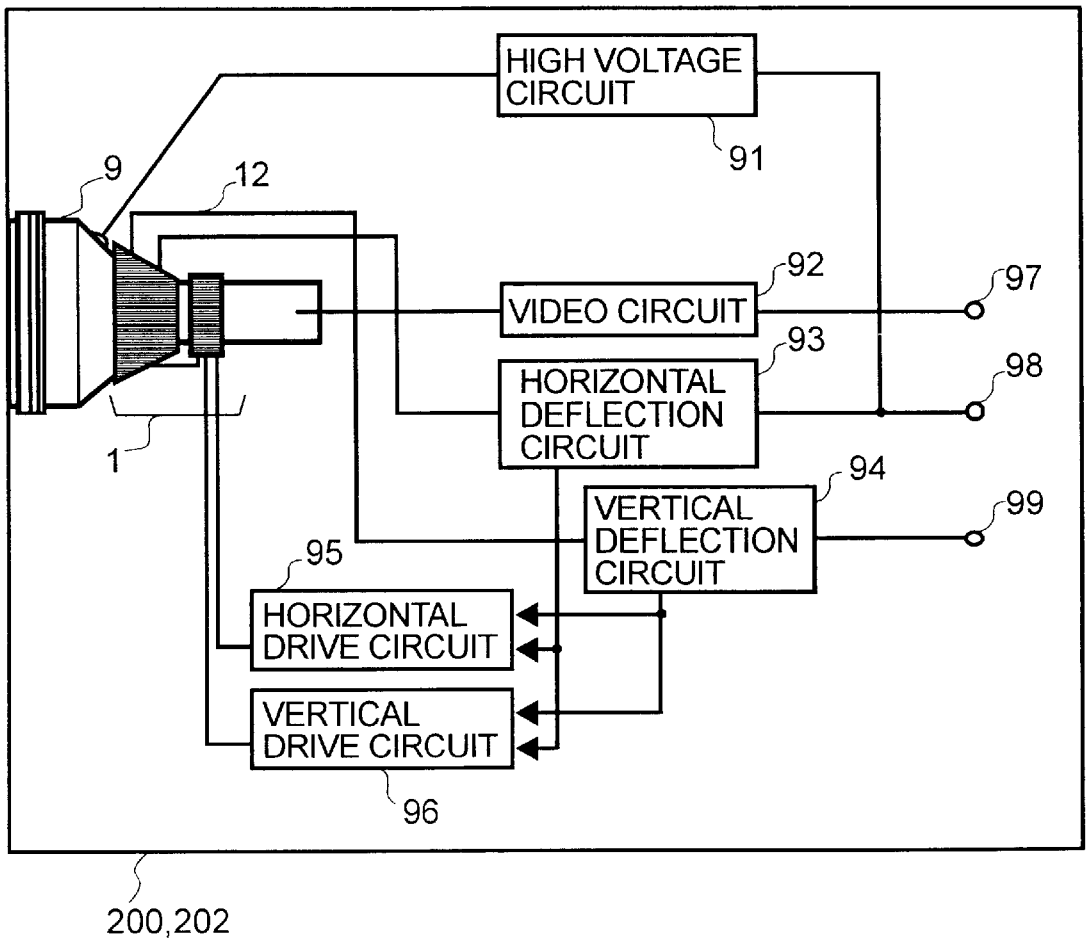
FIG. 1A is a block diagram of a cathode ray tube device according to the embodiment of the present invention.
Figure 1B:
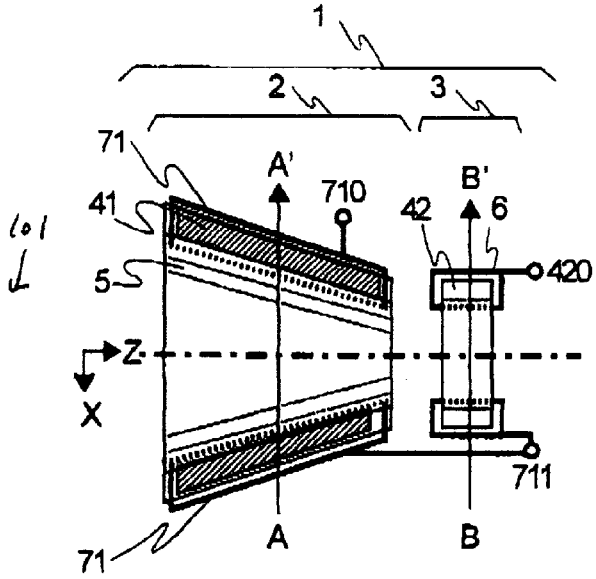
FIG. 1B is a schematic cross sectional view of a deflection yoke according to one embodiment of the present invention.
Figure 2:
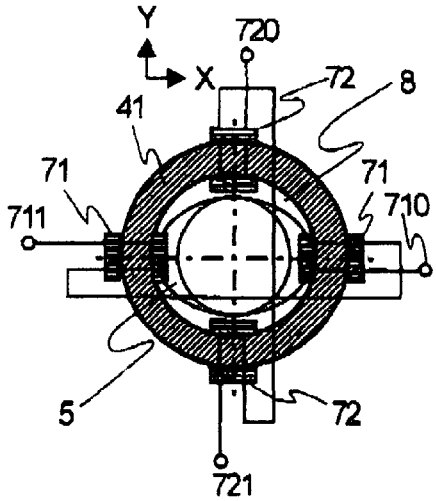
FIG. 2 is a schematic sectional view taken on A–A' of a deflection yoke according to one embodiment of the present invention.
Figure 3:
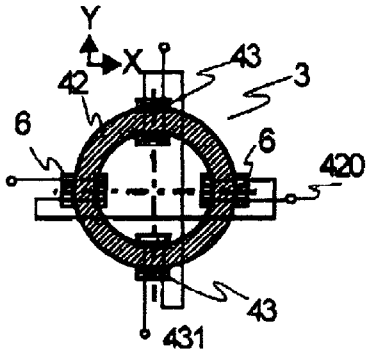
FIG. 3 is a schematic sectional view taken on B–B' of a deflection yoke according to one embodiment of the present invention.

A deflection yoke assembly and a cathode ray tube of a display device, according to embodiments of the present invention, will be described below with reference to FIGS. 1A to 9. FIG. 1A shows a display device 200 having a housing 202 and a cathode ray tube provided with a deflection yoke assembly 1 according to one embodiment of the present invention. The display device is a television or a computer monitor according to one embodiment of the present invention. The display device includes a cathode ray tube 9, a deflection yoke assembly 1, a high voltage circuit 91, a video circuit 92, a horizontal deflection circuit 93, a vertical deflection circuit 94, a horizontal drive circuit 95, a vertical drive circuit 96, a video signal input terminal 97, a horizontal synchronous signal input terminal 98, and a vertical synchronous signal input terminal. Herein below, the same component names and numerals are used to refer elements or features that are similar to above-mentioned elements or features.

Referring to FIGS. 1B to 3, reference numeral 1 designates a deflection yoke assembly, which is arranged in a cathode ray tube, and a fluorescent surface is provided on the left side 101 of the deflection yoke assembly. The deflection assembly 1 includes a first or main deflection yoke 2 (or main deflection section), a second or minor deflection yoke 3 (or secondary deflection section), a main core 41, a minor core 42, a main horizontal coil 5, a second auxiliary horizontal coil 6, a first auxiliary horizontal coil 71, a first auxiliary vertical coil 72, a second auxiliary vertical coil 43, and a main vertical coil 8. The main deflection yoke is provided proximate the fluorescent surface, and the minor deflection yoke is provide proximate in electron gun (not shown) and remote from the fluorescent surface according to one embodiment of the present invention. Since the minor deflection yoke 3 (i.e., the minor core) has a smaller inner diameter than that of the main deflection yoke 2 (i.e., the main yoke), the minor deflection yoke provides a higher deflection sensitivity than the main deflection yoke.

The main and minor cores 41 and 42 are metallic (e.g., iron) cylindrical-shaped objects whereupon respective coils are wound. The main horizontal and vertical coils and the first auxiliary horizontal and vertical coils are provided on the main core 41. The second auxiliary horizontal and vertical coils (or minor horizontal and vertical coils) are provided on the minor core 42. The first and second auxiliary horizontal coils are connected to each other in series or parallel. The first and second auxiliary vertical coils are connected to each other in series or parallel. The main horizontal and vertical coils are not coupled to the corresponding minor horizontal and vertical coils (or second auxiliary horizontal and vertical coils).

In one implementation, the deflection yoke assembly 1 includes the first auxiliary horizontal coils 71 and the first auxiliary vertical coils 72 that are wound toroidally about the main core 41, a terminal 711 of the first auxiliary horizontal coil 71 connected to the second auxiliary horizontal coil 6 in series or parallel, and a terminal 721 of the first auxiliary vertical coil 72 connected to a terminal 431 of a second auxiliary vertical coil 43 in series or parallel. While in FIG. 2, the first auxiliary horizontal coils 71 and the first auxiliary vertical coils 72 are respectively connected in series. In another implementation, they are connected in parallel.

As used herein, the term "deflection yoke assembly" refers to a device or component that is used to deflect or control a trajectory of an electron beam. The term "main deflection section" refers to a device or component in an electron beam deflection controlling device, e.g., a display device, cathode ray tube, or deflection yoke assembly, that provides a coarse deflection control of an electron beam traveling along a path. An example of the main deflection section is the main deflection yoke described herein. The term "minor deflection section" refers to a device or component in an electron beam deflection controlling device, e.g., a display device, cathode ray tube, or deflection yoke assembly, that provides a fine deflection control of an electron beam traveling along a path. An example of the minor deflection section is the minor deflection yoke described herein.

Referring back to FIG. 1A, a video signal is input from the video signal input terminal 97, and the signal is processed by the video circuit 92 and afterward supplied to a cathode of the cathode ray tube 9. A horizontal synchronous signal is input from the horizontal synchronous signal input terminal 98, and the signal input is supplied to the horizontal deflection circuit 93 to generate a horizontal deflection current. The horizontal deflection current generated is supplied to the main horizontal coil 5 of the deflection yoke assembly 1. Further, the horizontal synchronous signal is supplied to the high voltage circuit 91 and a high voltage is applied to an anode of the cathode ray tube 9. A vertical synchronous signal is input from the vertical synchronous signal input terminal 99, and the signal input is supplied to the vertical deflection circuit 94 to generate a vertical deflection current. The vertical deflection current generated is supplied to the main vertical coil 8 of the deflection yoke 1. In this manner, the cathode ray tube device is driven.

When the deflection yoke assembly 1 of the present embodiment is applied to the cathode ray tube device, high sensitivity and a low crosstalk voltage can be realized with a relatively simple device design. Accordingly, the cathode ray tube 9 requires significantly less power to drive the horizontal drive circuit 95 and the vertical drive circuit 96, as described in more detail below.

Figure 4:
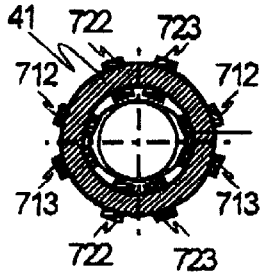
FIG. 4 is a schematic sectional view taken on A–A' of a deflection yoke according to one embodiment of the present invention.

FIG. 4 illustrates a cross-sectional view of the main core 41 taken along an arrow A–A' according to another embodiment of the present invention. In FIG. 4, the first auxiliary horizontal coil 71 includes first and second sub-coils 712 and 713 to be wound about the main core and the first auxiliary vertical coil 72 includes first and second sub-coils 722 and 723 to be wound about the main core. A magnetic field distribution formed by the horizontal sub-coils 712 and 713, and the vertical sub-coils 722 and 723 shows a uniform magnetic field distribution, which facilitates in reducing the crosstalk voltage.

In another embodiment, the first auxiliary horizontal coil 71 and the first auxiliary vertical coil 72 are formed using a saddle-winding method within the first deflection yoke 2, thereby obtaining similar effects as described above.

Figure 5:
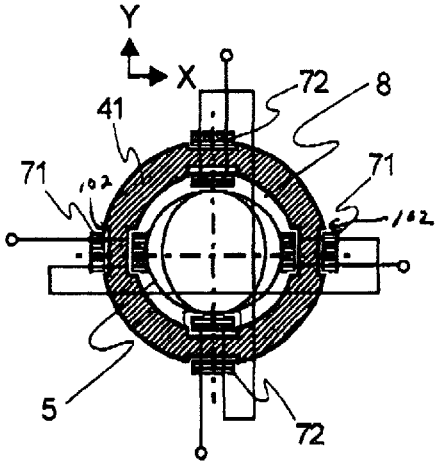
FIG. 5 is a schematic sectional view taken on A–A' of a deflection yoke according to one embodiment of the present invention.

FIG. 5 shows a cross-sectional view taken on A–A' of a main deflection yoke 2 according to another embodiment of the present invention. As in elsewhere, the same names and numerals are used to refer elements or features that are similar to above-mentioned elements or features. For example, the main deflection yoke 2 of FIG. 5 uses the same name and numeral as that of FIG. 2 although they refer to different, yet similar components. The main deflection yoke 2 of FIG. 5 includes a main core 41 having a plurality of markings 102 on its inner surface or outer surface, or both. The markings 102 are configured to facilitate precise wounding of the first horizontal and vertical auxiliary coils 71 and 72 about the main core. In one embodiment, the markings 102 are provided by varying the thickness of the main core 41, e.g., indentations are made on portions of the main core 41 whereon the first horizontal and vertical auxiliary coils 71 and 72 are to be wound toroidally. The indentations can be made on the inner surface or the outer surface, or both. With such markings, the auxiliary coils can be wound more easily and precisely, thereby providing a greater deflection sensitivity for the deflection assembly 1. In one embodiment, similar markings are provided on the minor core 42 to facilitate precise wounding of the second auxiliary vertical and horizontal coils.

Figure 6:
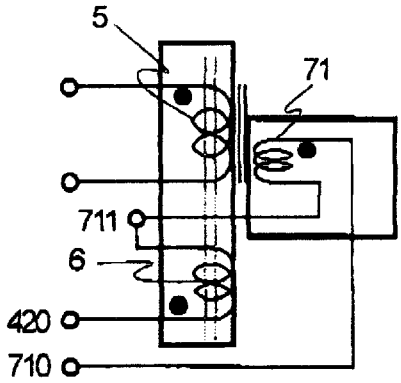
FIG. 6 is an explanatory view of the principle involved in one embodiment of the present invention.
Figure 7:
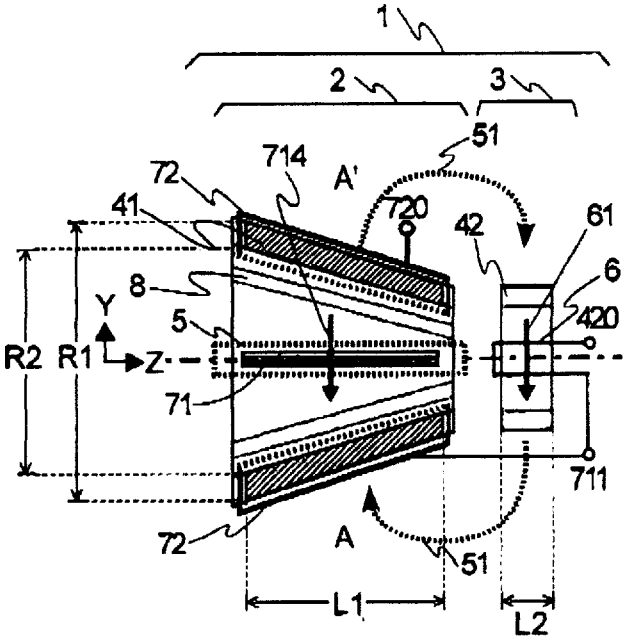
FIG. 7 is an explanatory view of the principle involved in one embodiment of the present invention.
Figure 8:
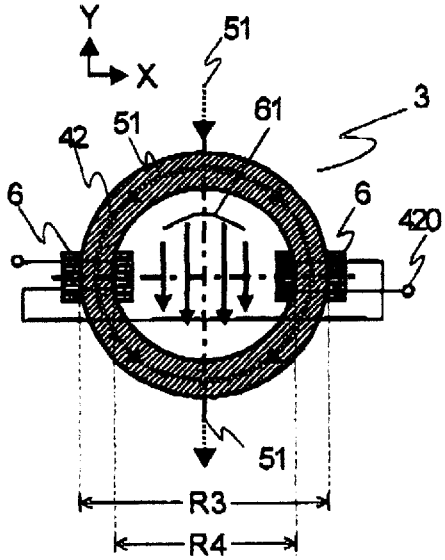
FIG. 8 is an explanatory view of the principle involved in one embodiment of the present invention.

FIGS. 6 to 8 illustrate a principle used to suppress a crosstalk voltage according to one embodiment of the present invention. The main horizontal coil 5, the second auxiliary horizontal coil 6, and the first auxiliary horizontal coil 71 are used in this illustration. A magnetic field leakage 51 generated by the main horizontal coil 5, as shown in FIGS. 7 and 8, passes through the minor core 42 arranged in the minor deflection yoke 3 from the neck side (e.g., the left side of the minor deflection yoke 3 in FIG. 7) of the main deflection yoke 2, generating a crosstalk voltage in the second auxiliary horizontal coil 6.

However, as shown in FIG. 6, a winding direction of the first auxiliary horizontal coil 71 is arranged so that a "reverse crosstalk" voltage is generated by the first auxiliary coil 71. The first auxiliary coil 71 provided on the main coil 41 is coupled to the second auxiliary coil 6 via the terminal 711. Accordingly, the "reverse crosstalk" voltage offsets or suppresses the crosstalk voltage generated in the second auxiliary coil 6, thereby significantly reducing the crosstalk voltage across a terminal 420 and a terminal 710. This provides substantial improvement in dynamic range of a drive circuit associated with the deflection yoke.

Referring to FIGS. 7 and 8, a first auxiliary horizontal magnetic field 714 generated by the first auxiliary horizontal coil 71 and a second auxiliary horizontal magnetic field 61 generated by the second auxiliary horizontal coil 6 are generated in the same direction, that is, these magnetic fields are added, thereby significantly increasing the deflection sensitivity. While the above description has been made using the main horizontal coil 5, the second auxiliary horizontal coil 6, and the first auxiliary horizontal coil, a similar effect can be obtained from the main vertical coil 8, the first auxiliary vertical coil 72, and the second auxiliary vertical coil 43.

Figure 9:
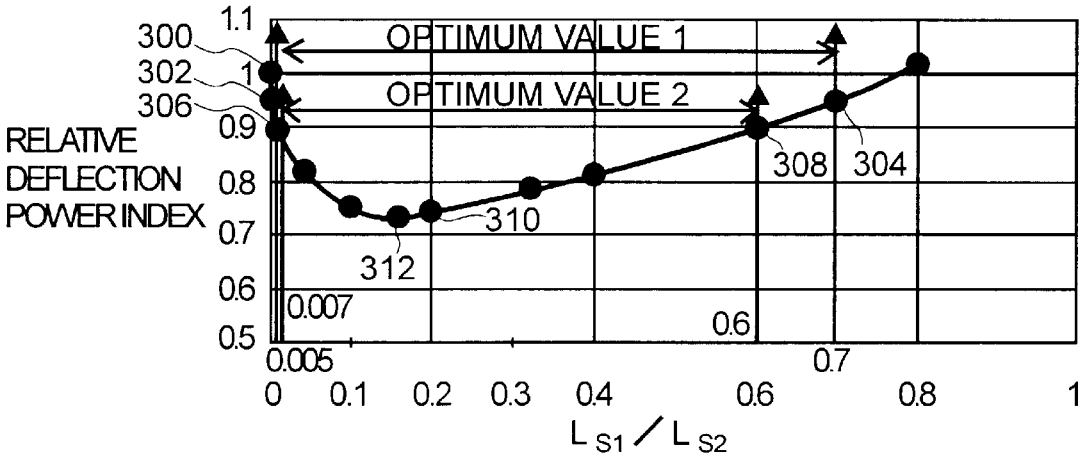
FIG. 9 is a characteristic view of deflection sensitivity according one embodiment of the present invention.

FIG. 9 shows a characteristic of deflection sensitivity of a minor deflection yoke 3 of a deflection yoke assembly 1 according to one embodiment of the present invention. In FIG. 9, $L_{s1}$ refers to an inductance of the first auxiliary horizontal coil 71, $L_{s2}$ refers to an inductance of the second auxiliary horizontal coil 6, a Y-axis represents a relative power index of the minor deflection yoke 3, and an X-axis represents the ratio of $L_{s1}$ over $L_{s2}$. The Y-axis also represents the deflection sensitivity of the deflection yoke assembly 3, where the sensitivity increases as the relative deflection power index decreases.

Values of the $L_{s1}$ and $L_{s2}$ vary according to the number of turns wound about the main and minor cores 41 and 42. In one embodiment, the value $L_{s1}$ is obtained by wounding a coil toroidally about the main core 1–8 times (i.e., 1–8 turns), preferably 2–6 times, more preferably 2–5 or 3–4 times. The value $L_{s2}$ is obtained by wounding the same type of coil toroidally about the minor core 10–50 times (i.e., 10–50 turns), preferably 15–40 times, more preferably 20–30 times. In the present embodiment, the main core 41 has an outer radius (R1) of 55 mm, and an inner radius (R2) of 48 mm (i.e., a thickness of 3.5 mm), and the height or length (L1) of 28 mm. The minor core 42 has an outer radius (R3) of 42 mm, and an inner radius (R4) of 31 mm (i.e., a thickness of 5.5 mm), and the height or length (L2) of 15 mm.

Referring back to FIG. 9, a point 300, where X is 0 and Y is 1, represents a situation where the deflection yoke assembly 1 has only the second horizontal auxiliary coils on the minor core 42 and no first auxiliary horizontal coils on the main core 41.

Generally, if the relative deflection power index is improved by 5% or more, a significant improvement can be obtained in reducing loss of power (about 4%), i.e., power consumption, by the horizontal drive circuit 95 and the vertical drive circuit 96 of FIG. 1A. In one embodiment, this 5% improvement occurs at a point 302 where X is 0.007, at a point 304 where X is 0.7. While improving sensitivity, this reduction in power loss also enables use of a smaller radiation plate to dissipate heat generated in the periphery circuitry. If the relative deflection power index is improved by 10% or more, a rating of a transistor of the horizontal drive circuit 95 and the vertical drive circuit 96 can be made small by one rank, enabling a considerable reduction in cost. The 10% improvement occurs at a point 306 where X is 0.005 and at a point 308 where X is 0.6. An even better result may be obtained at a point 310 where X is between about 0.1 to about 0.3 or a point 312 where X is between about 0.1 to about 0.2.

Accordingly, the present inventors have discovered that the deflection yoke assembly 1 of the display device consumes low power and provides high sensitivity when the inductances of the first and second auxiliary coils are set with the following parameters: $0.005 \leqq L_{s1}/L_{s2} \leqq 0.7$, or preferably $0.007 \leqq L_{s1}/L_{s2} \leqq 0.6$, or more preferably $0.01 \leqq L_{s1}/L_{s2} \leqq 0.2$. The power index issues described above using the first and second auxiliary horizontal coils similarly apply to the first and second auxiliary vertical coils as well.

According to the embodiments described above, an improved display device having a deflection yoke assembly that provides a simplified design, increases the deflection sensitivity, decreases the relative power index, and reduces a crosstalk voltage. The deflection yoke assembly includes a main deflection yoke where a first auxiliary coil is provided and a minor deflection yoke where a second auxiliary coil is provided. The auxiliary coils are coupled to each other in series or parallel.

The above embodiments have been used merely to describe the present invention and should not be used to limit the scope of the present invention. Accordingly, the scope of the present invention is defined according to the appended claims.

What is claimed is:

1. An electron beam trajectory controlling device, comprising:

a main deflection section having a first main coil and defining a first path and being configured to control a trajectory of an electron traveling along the first path, the main deflection section including a first auxiliary coil provided proximate the first main coil, the first auxiliary coil not being electrically coupled to the first main coil; and a minor deflection section provided adjacent to the main deflection section and having a first minor coil that is coupled to the first auxiliary coil, the minor deflection section defining a second electron path that is aligned to the first path, the minor deflection section cooperating with the main deflection section to control the trajectory of the electron.

2. The device of claim 1, wherein the electron beam trajectory controlling device is a deflection yoke assembly or a cathode ray tube, and the first minor coil is not coupled to the first main coil, the first auxiliary coil cooperating with the first minor coil to suppress a crosstalk voltage in the minor deflection section.

3. The device of claim 1, wherein the main deflection section is a main deflection yoke and the minor deflection section is a minor deflection yoke.

4. The device of claim 1, further comprising:

a second main coil provided in the main deflection section, the second main coil and the first main coil together defining the first path and cooperating with each other to control the trajectory of the electron;

a second auxiliary coil provided in the main deflection section; and a second minor coil provided in the minor deflection section and cooperating with the first minor coil to control the trajectory of the electron, the second minor coil being coupled to the second auxiliary coil.

5. The device of claim 4, wherein the first main coil and the first minor coil are configured to control the electron trajectory along a first direction, and where the second main coil and the second minor coil are configured to control the electron trajectory along a second direction that is orthogonal to the first direction.

6. The device of claim 5, wherein the first direction is an orthogonal direction to the electron trajectory and the second direction is an orthogonal direction to the electron trajectory and the first direction, the first main and minor coils being horizontal components and the second main and minor components being vertical components with respect to the electron trajectory.

7. The device of claim 5, further comprising:

a main core provided in the main deflection section, wherein the first and second auxiliary coils are wound around the main core; and a minor core provided in the minor deflection section, wherein the first and second minor coils are wound toroidally around the minor core.

8. The device of claim 7, wherein the main core includes one or more markings to facilitate wounding of at least the first auxiliary coil around the main core.

9. The device of claim 7, wherein the minor core includes one or more marking to facilitate wounding of at least the first minor coil around the minor core.

10. The device of claim 7, wherein a ratio of inductances of two corresponding non-main coils is between about 0.005 and about 0.7.

11. The device of claim 10, wherein the two corresponding non-main coils are the first auxiliary coil and the first minor coil, where $L_{a1}$ denotes the inductance of the first auxiliary coil and $L_{m1}$ denotes the inductance of the first minor coil, where the ratio of the inductances is $0.005 \leqq L_{a1}/L_{m1} \leqq 0.7$.

12. The device of claim 1, wherein the main deflection section is provided proximate a fluorescent surface, and the minor deflection section provided proximate an electron gun.

13. The device of claim 1, wherein the main deflection section provides a coarser deflection control of the electron beam than the minor deflection section.

14. The device of claim 1, wherein neither a terminal of the first minor coil nor a terminal of the first auxiliary coil is coupled to the first main coil directly.

15. A device for deflecting an electron beam, comprising:

a main deflection section defining a first path and being configured to deflect the electron beam traveling along the first path, the main deflection section providing a coarse deflection control of the electron beam, the main deflection section including a first main conductive component configured to generate a magnetic field to deflect the electron beam traveling along the first path in a first direction, a second main conductive component configured to generate a magnetic field to deflect the electron beam traveling along the first path in a second direction, a first auxiliary conductive component, and a second auxiliary conductive component; and a minor deflection section provided adjacent to the main deflection section, the minor deflection section defining a second path that is aligned to the first path and providing a fine deflection control of the electron beam, the minor deflection including a first minor conductive component that is coupled to the first auxiliary conductive component and configured to deflect the electron beam along the first direction, and a second minor conductive component that is coupled to the second auxiliary conductive component and configured to deflect the electron beam along the second direction, wherein the first auxiliary conductive component cooperates with the first minor conductive component to reduce a crosstalk voltage generated in the minor deflection section;

wherein the first minor conductive component is not coupled to the first major conductive component.

16. The device of claim 15, wherein inductances of the first auxiliary and minor conductive components are set to satisfy the following condition, $0.005 \leqq L_{a1}/L_{m1} \leqq 0.7$, where $L_{a1}$ denotes the inductance of the first auxiliary conductive component and $L_{m1}$ denotes the inductance of the first minor conductive component.

17. The device of claim 15, wherein inductances of the first auxiliary and minor conductive components are met to satisfy the following condition, $0.007 \leqq L_{a1}/L_{m1} \leqq 0.6$, where $L_{a1}$ denotes the inductance of the first auxiliary conductive component and $L_{m1}$ denotes the inductance of the first minor conductive component.

18. The device of claim 15, wherein inductances of the first auxiliary and minor conductive components are set to satisfy the following condition, $0.01 \leqq L_{a1}/L_{m1} \leqq 0.3$, where $L_{a1}$ denotes the inductance of the first auxiliary conductive component and $L_{m1}$ denotes the inductance of the first minor conductive component.

19. The device of claim 15, wherein the main deflection section is provided proximate a fluorescent surface, and the minor deflection section is provided proximate an electron gun.

20. The device of claim 15, wherein the main deflection section provides a coarser deflection control of the electron beam than the minor deflection section.

21. A cathode ray tube, comprising:

a display surface; and a deflection assembly including a main deflection section having a first main coil and defining a first electron beam path and being configured to control a trajectory of an electron beam traveling along the first path, the main deflection section including a first auxiliary coil provided proximate the first main coil, the first auxiliary coil not being electrically connected to the first main coil, and a minor deflection section provided adjacent to the main deflection section, the minor deflection section having a first minor coil that is coupled to the first auxiliary coil and defining a second electron beam path that is aligned to the first electron beam path, the minor deflection section cooperating with the main deflection section to control the trajectory of the electron beam.

22. The device of claim 21, wherein inductances of the first auxiliary and minor coils are set to satisfy the following condition, $0.005 \leqq L_{a1}/L_{m1} 0.7$, where $L_{a1}$ denotes the inductance of the first auxiliary coil and $L_{m1}$ denotes the inductance of the first minor coil.

23. The device of claim 22, wherein the inductances of the first auxiliary and minor coils are set to satisfy the following condition, $0.007 \leqq L_{a1}/L_{m1} \leqq 0.6$.

24. A device used for displaying images, comprising:

a housing having an opening; and a cathode ray tube provided within the housing and having a display surface, the display surface aligned to the opening of the housing, the cathode ray tube including a main deflection section having a first main coil and defining a first electron path and being configured to control a trajectory of an electron traveling along the first electron path, the main deflection section including a first auxiliary coil provided proximate the first main coil, and a minor deflection section provided adjacent to the main deflection section and having a first minor coil that is coupled to the first auxiliary coil, the minor deflection section defining a second electron path that is aligned to the first electron path, the minor deflection section cooperating with the main deflection section to control the trajectory of the electron, wherein inductances of the first auxiliary and minor coils are set to satisfy the following condition, $0.005 \leqq L_{a1}/L_{m1} \leqq 0.7$, where $L_{a1}$ denotes the inductance of the first auxiliary coil and $L_{m1}$ denotes the inductance of the first minor coil.

25. The device of claim 24, wherein the inductances of the first auxiliary and minor coils are set to satisfy the following condition, $0.01 \leqq L_{a1}/L_{m1} \leqq 0.3$.

26. An electron beam trajectory controlling device, comprising:

a main deflection section having a main core, a main horizontal coil, a main vertical coil, a first auxiliary horizontal coil, and a first auxiliary vertical coil, the main deflection section providing a coarse control of a trajectory of an electron beam from an electron gun; and a minor deflection section provided between the main deflection section and the electron gun, the minor deflection section having a minor core, a second auxiliary horizontal coil coupled to the first auxiliary horizontal coil and a second auxiliary vertical coil coupled to the first auxiliary vertical coil, the minor deflection section providing a fine control of the trajectory of the electron beam, wherein the horizontal coils are configured to control the trajectory of the electron beam along a first direction, and the vertical coils are configured to control the trajectory of the electron beam along a second direction that is orthogonal to the first direction.

27. The device of claim 26, wherein the main horizontal coil is not coupled to the second auxiliary horizontal coil, and the main vertical coil is not coupled to the second auxiliary vertical coil.

28. The device of claim 26, wherein the first and second auxiliary horizontal coils are coupled to each other in series or parallel.

29. The device of claim 28, wherein the first and second auxiliary vertical coils are coupled to each other in series or parallel.

30. The device of claim 29, wherein the first auxiliary horizontal coil includes first and second horizontal sub-coils wound around the main core.

31. The device of claim 30, wherein the first auxiliary vertical coil includes first and second vertical sub-coils wound around the main core.

32. The device of claim 26, wherein the first auxiliary vertical coil includes first and second vertical sub-coils wound about portions of the main core, and the first auxiliary vertical coil includes first and second vertical sub-coils wound about portions of the main core.

33. The device of claim 32, wherein the first and second horizontal sub-coils and the first and second vertical sub-coils are configured to provide a uniform magnetic field distribution to reduce a crosstalk voltage.

34. The device of claim 26, wherein the main horizontal coil generates a magnetic field leakage that generates a crosstalk voltage in the second auxiliary horizontal coil, wherein the first auxiliary horizontal coil is wound around the main core in such a way to generate a reverse crosstalk voltage that at least partially offsets the crosstalk voltage generated in the second auxiliary horizontal coil by the magnetic field leakage.

35. The device of claim 34, wherein the first auxiliary horizontal coil generates a first magnetic field and the second auxiliary horizontal coil generates a second magnetic field, the first and second magnetic fields being provided with the same direction, so that a deflection sensibility of the minor deflection section is increased.

36. The device of claim 35, wherein inductances of the first auxiliary horizontal coil and the second auxiliary horizontal coils satisfy the following condition, $0.01 \leqq L_{ah1}/L_{ah2} \leqq 0.3$, wherein $L_{ah1}$ denotes the inductance of the first auxiliary horizontal coil, and $L_{ah2}$ denotes the inductance of the second auxiliary horizontal coil.

37. The device of claim 26, wherein inductances of the first and second auxiliary horizontal coils satisfy the following condition, $0.005 \leqq L_{ah1}/L_{ah2} \leqq 0.7$, where $L_{ah1}$ denotes the inductance of the first auxiliary horizontal coil and $L_{ah2}$ denotes the inductance of the second auxiliary horizontal coil.

38. An electron beam trajectory controlling device, comprising:

a main deflection yoke having a main core, a main horizontal coil, a main vertical coil, a first auxiliary horizontal coil, and a first auxiliary vertical coil, the main core defining a first opening, the main deflection yoke being configured to control a trajectory of an electron beam emitted by an electron gun as the electron beam passes through the first opening; and a minor deflection yoke provided between the main deflection yoke and the electron gun, the minor deflection yoke having a minor core, a second auxiliary horizontal coil coupled to the first auxiliary horizontal coil and a second auxiliary vertical coil coupled to the first auxiliary vertical coil, the minor core defining a second opening aligned to the first opening, the minor deflection yoke being configured to control the trajectory of the electron beam as the electron beam passes through the second opening, wherein the horizontal coils are configured to control the trajectory of the electron beam along a first direction, and the vertical coils are configured to control the trajectory of the electron beam along a second direction that is orthogonal to the first direction, wherein the main horizontal coil is not coupled to the second auxiliary horizontal coil, and the main vertical coil is not coupled to the second auxiliary vertical coil, wherein the first auxiliary horizontal coil generates a first magnetic field and the second auxiliary horizontal coil generates a second magnetic field, the first and second magnetic fields having substantially the same direction, so that a deflection sensibility of the minor deflection yoke is increased, wherein the main horizontal coil generates a magnetic field leakage that generates a crosstalk voltage in the second auxiliary horizontal coil, the first auxiliary horizontal coil being configured to generate a reverse crosstalk voltage to at least partially offset the crosstalk voltage generated in the second auxiliary horizontal coil by the magnetic field leakage, wherein inductances of the first and second auxiliary horizontal coils satisfy the following condition, $0.005 \leqq L_{ah1}/L_{ah2} \leqq 0.7$, where $L_{ah1}$ denotes the inductance of the first auxiliary horizontal coil and $L_{ah2}$ denotes the inductance of the second auxiliary horizontal coil.

39. A device for a display device, comprising:

a main deflection section having a main core, a main horizontal coil, a main vertical coil, a first auxiliary horizontal coil, and a first auxiliary vertical coil, the main deflection being configured to provide a coarse control of a trajectory of an electron beam from an electron gun as the electron beam passes through the main core, the first auxiliary horizontal coil including first and second horizontal sub-coils wound about portions of the main core, the first auxiliary vertical coil including first and second vertical sub-coils wound about portions of the main core; and a minor deflection section provided between the main deflection section and the electron gun, the minor deflection section having a minor core, a second auxiliary horizontal coil coupled to the first auxiliary horizontal coil and a second auxiliary vertical coil coupled to the first auxiliary vertical coil, the minor deflection section being configured to provide a fine control of the trajectory of the electron beam as the electron beam passes through the minor core, wherein the main horizontal coil is not coupled to the second auxiliary horizontal coil, and the main vertical coil is not coupled to the second auxiliary vertical coil, wherein the first auxiliary horizontal coil generates a first magnetic field and the second auxiliary horizontal coil generates a second magnetic field, the first and second magnetic fields having substantially the same direction to increase a deflection sensibility of the minor deflection section, wherein the main horizontal coil generates a magnetic field leakage that, in turn, generates a crosstalk voltage in the second auxiliary horizontal coil, the first auxiliary horizontal coil being configured to generate a reverse crosstalk voltage to at least partially offset the crosstalk voltage generated in the second auxiliary horizontal coil by the magnetic field leakage, wherein inductances of the first and second auxiliary horizontal coils satisfy the following condition, $0.005 \leqq L_{ah1}/L_{ah2} \leqq 0.7$, where $L_{ah1}$ denotes the inductance of the first auxiliary horizontal coil and $L_{ah2}$ denotes the inductance of the second auxiliary horizontal coil, wherein inductances of the first and second auxiliary vertical coils satisfy the following condition, $0.005 \leqq L_{av1}/L_{ah2} \leqq 0.7$, where $L_{av1}$ denotes the inductance of the first auxiliary vertical coil and $L_{av2}$ denotes the inductance of the second auxiliary vertical coil.

40. The device of claim 39, wherein inductances of the first and second auxiliary horizontal coils satisfy the following condition, $0.01 \leqq L_{ah1}/L_{ah2} \leqq 0.2$, where $L_{ah1}$ denotes the inductance of the first auxiliary horizontal coil and $L_{ah2}$ denotes the inductance of the second auxiliary horizontal coil, wherein the inductances of the first and second auxiliary vertical coils satisfy the following condition, $0.01 \leqq L_{av1}/L_{ah2} \leqq 0.2$, where $L_{av1}$ denotes the inductance of the first auxiliary vertical coil and $L_{av2}$ denotes the inductance of the second auxiliary vertical coil.

* * * * *